US010401756B2

(12) United States Patent
Sakamaki

(10) Patent No.: US 10,401,756 B2
(45) Date of Patent: Sep. 3, 2019

(54) IMAGE FORMING APPARATUS

(71) Applicant: CANON KABUSHIKI KAISHA, Tokyo (JP)

(72) Inventor: Tomoyuki Sakamaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/951,749

(22) Filed: Apr. 12, 2018

(65) Prior Publication Data

US 2018/0321612 A1 Nov. 8, 2018

(30) Foreign Application Priority Data

May 2, 2017 (JP) ..... 2017-091716

(51) Int. Cl.
*G03G 15/00* (2006.01)
*G03G 15/08* (2006.01)
(Continued)

(52) U.S. Cl.
CPC ..... *G03G 15/0808* (2013.01); *G03G 5/102* (2013.01); *G03G 5/147* (2013.01); *G03G 15/0818* (2013.01); *G03G 15/50* (2013.01); *G03G 15/5008* (2013.01); *G03G 15/75* (2013.01); *G03G 21/0011* (2013.01); *G03G 15/0121* (2013.01); *G03G 15/0921* (2013.01); *G03G 2215/00962* (2013.01); *G03G 2215/0404* (2013.01); *G03G 2215/0607* (2013.01); *G03G 2215/0636* (2013.01)

(58) Field of Classification Search
CPC ..... G03G 15/808; G03G 15/818; G03G 15/5008; G03G 5/147
See application file for complete search history.

(56) References Cited

U.S. PATENT DOCUMENTS 7,551,878 B2 6/2009 Ogaki et al.
7,556,901 B2 7/2009 Anezaki et al.
(Continued)

FOREIGN PATENT DOCUMENTS

JP 62-278522 A 12/1987
JP 2003-208027 A 7/2003
JP 2007-233355 A 9/2007

*Primary Examiner* — David M. Gray
*Assistant Examiner* — Andrew V Do
(74) *Attorney, Agent, or Firm* — Venable LLP

(57) ABSTRACT

An image forming apparatus includes a rotatable image bearing member and a rotatable developer bearing member. The image bearing member, configured to carry a toner image, includes first recess portions provided at intervals substantially equal to a first pitch Pdr (mm) in a rotation direction of the image bearing member. The developer bearing member, configured to carry developer comprising toner and carrier and to form the toner image on the image bearing member, includes second recess portions provided at intervals substantially equal to a second pitch Ps (mm) in a rotation direction of the developer bearing member. The following relationship is satisfied $$Vs/Vdr < Ws/Pdr$$

where Vdr represents a movement speed (mm/sec) of the first recess portions, Vs represents a movement speed (mm/sec) of the second recess portions, and Ws represents a length (mm) of each of the second recess portions in the rotation direction of the developer bearing member.

12 Claims, 5 Drawing Sheets

(51) Int. Cl.

| | |
|---|---|
| ***G03G 5/147*** | (2006.01) |
| ***G03G 5/10*** | (2006.01) |
| ***G03G 21/00*** | (2006.01) |
| *G03G 15/01* | (2006.01) |
| *G03G 15/09* | (2006.01) |

(56) References Cited

U.S. PATENT DOCUMENTS

| | | | | |
|---|---|---|---|---|
| 7,622,238 | B2 | 11/2009 | Uematsu et al. | |
| 7,718,331 | B2 | 5/2010 | Uematsu et al. | |
| 7,749,667 | B2 | 7/2010 | Kawahara et al. | |
| 9,052,634 | B2 * | 6/2015 | Furukawa | G03G 15/065 |
| 2008/0096123 | A1 | 4/2008 | Shimada et al. | |
| 2009/0170023 | A1 | 7/2009 | Shimada et al. | |
| 2015/0338780 | A1 * | 11/2015 | Matsumoto | G03G 15/0907 399/276 |

* cited by examiner

IMAGE FORMING APPARATUS

BACKGROUND OF THE INVENTION

Field of the Invention

The present invention relates to an image forming apparatus of, for example, an electrophotographic system or an electrostatic recording system, and particularly to an image forming apparatus that uses two-component developer which is a mixture of nonmagnetic toner and magnetic carrier.

Description of the Related Art

In an image forming apparatus such as a copier employing an electrophotographic system, a visible image is formed by attaching developer to an electrostatic latent image formed on an image bearing member. Hereinafter, the image bearing member will be also referred to as a photosensitive drum. Conventionally, a developing unit that uses two-component developer including toner and magnetic carrier is known. As such a developing unit, a unit that conveys two-component developer to the vicinity of a photosensitive drum while magnetically attaching the two-component developer to a rotating developer bearing member and thus develops an electrostatic latent image on the photosensitive drum into a visible image by toner in the developer is widely used. Hereinafter, the developer bearing member will be also referred to as a developing sleeve.

In this method, the developer is magnetically held on the developing sleeve by providing a magnet fixedly disposed inside the rotating developing sleeve. It is general that the two-component developer is further conveyed to the vicinity of a photosensitive member while regulating the amount of the two-component developer by disposing a regulation blade so as to oppose the developing sleeve in a certain distance from the developing sleeve. In order to stably convey the developer at this time, conventionally, a developing sleeve whose surface is roughened by sand blasting using abrasive grains or a developing sleeve whose surface is provided with a plurality of grooves extending parallel to the rotation axis of the developing sleeve is generally used.

The developing sleeve roughened by sand blasting has a problem that the developer conveyance performance thereof decreases if the degree of roughness is low. Meanwhile, there is also a problem that, in the case where the degree of roughness is increased to improve the developer conveyance performance, the developing sleeve needs to be blasted by strongly hitting the abrasive grains and thus the developing sleeve is deformed. Therefore, the developing sleeve that has been subjected to sand blasting is usually used with a low degree of roughness. This is likely to cause a problem that the recesses and projections on the developing sleeve are worn out after use of a long period and the performance of conveying developer decreases. This can be a cause of shortening the lifetime of the developing unit.

In recent years, the demand for high quality, high reliability, and high stability of image forming apparatus has been growing. In satisfying the demand for these, stability over time of the amount of developer on the developing sleeve is important. Therefore, in Japanese Patent Laid-Open No. 2003-208027, a developing sleeve in which a plurality of grooves extending parallel to the rotation axis of the developing sleeve is proposed. Since the grooves are defined by, for example, a drawing process using a die, according to this developing sleeve, the degree of roughness can be increased without deforming the developing sleeve as in sand blasting. Therefore, this developing sleeve is less likely to be influenced by wear from long-time use compared with a developing sleeve subjected to sand blasting, and thus the performance of conveying developer can be stabilized.

However, although the developing sleeve provided with grooves has a stable performance of conveying developer, there is a risk that periodical density unevenness appears in the conveyance state of the developer on the developing sleeve due to the pitch of periodical recesses of the grooves. There is a possibility that the periodical density unevenness appearing in the conveyance state is made visible as density unevenness in an image corresponding to the period thereof. For example, in the case where periodical density unevenness occurs, the visual sensitivity of a person visually recognizing the density unevenness differs depending on the pitch, and it is said that the visual sensitivity drops drastically in the case where the spatial frequency of the density unevenness is larger than 1 line/mm as shown in FIG. 5 of Japanese Patent Laid-Open No. 62-278522. Therefore, the periodical density unevenness can be made less visible by reducing the pitch of the grooves on the developing sleeve as much as possible.

Meanwhile, since durability such as wear resistance against mechanical external force applied by, for example, charging and cleaning, is required for the surface of a photosensitive drum, a technique of using a resin having a high wear resistance as a surface layer of the photosensitive drum is known. Examples of the resin include curable resin. Examples of a problem that arises as a result of increasing the wear resistance of the surface of the photosensitive drum includes decrease in cleanability caused by increase in the rotational torque due to increase in the dynamic friction coefficient of the surface of the photosensitive drum. To solve such a problem, Japanese Patent Laid-Open No. 2007-233355 proposes a technique of providing periodical recess portions on the circumferential surface of a photosensitive drum. However, such periodical recess portions on the photosensitive drum can be also made visible as density unevenness in an image corresponding to the period thereof. Similarly to the case of the grooves of the developing sleeve described above, the periodical density unevenness can be made less visible by reducing the pitch of the recess portions of the photosensitive drum as much as possible, specifically, by setting the pitch to 1 line/mm or smaller.

However, in the developing sleeve of Japanese Patent Laid-Open No. 2003-208027 or the photosensitive drum of Japanese Patent Laid-Open No. 2007-233355, even if the grooves or the recess portions are provided to have a pitch of 1 line/mm or smaller, an opposing pattern that opposes the grooves or the recess portions in a developing region is not considered. Therefore, in the case where development is performed on the photosensitive drum provided with the periodical recess portions by using the developing sleeve provided with the periodical grooves, there is a risk that a large periodical density unevenness occurs due to the occurrence of beat between the frequencies of the two and the density unevenness becomes more visible. This beat is density unevenness periodically occurring at a larger pitch than the pitch of the recess portions of the developing sleeve as a result of recess portions of the developing sleeve not opposing the recess portions of the photosensitive drum and not increasing the density being interposed between recess portions of the developing sleeve that oppose the recess portions of the photosensitive drum and increase the density. Therefore, even if the period of the recess portions of each of the developing sleeve and the photosensitive drum is set to 1 mm or smaller, there is a risk that density unevenness of a pitch larger than 1 mm occurs due to the beat and the density unevenness becomes more visible.

SUMMARY OF THE INVENTION

According to one aspect of the present invention, an image forming apparatus includes a rotatable image bearing member, configured to carry a toner image, with first recess portions provided at intervals substantially equal to a first pitch Pdr (mm) in a rotation direction of the image bearing member, and a rotatable developer bearing member, configured to carry developer comprising toner and carrier and to form the toner image on the image bearing member, with second recess portions provided at intervals substantially equal to a second pitch Ps (mm) in a rotation direction of the developer bearing member, wherein the following relationship is satisfied $$Vs/Vdr<Ws/Pdr$$

where Vdr represents a movement speed (mm/sec) of the first recess portions, Vs represents a movement speed (mm/sec) of the second recess portions, and Ws represents a length (mm) of each of the second recess portions in the rotation direction of the developer bearing member.

Further features of the present invention will become apparent from the following description of exemplary embodiments with reference to the attached drawings.

DESCRIPTION OF THE EMBODIMENTS

Figure 1:
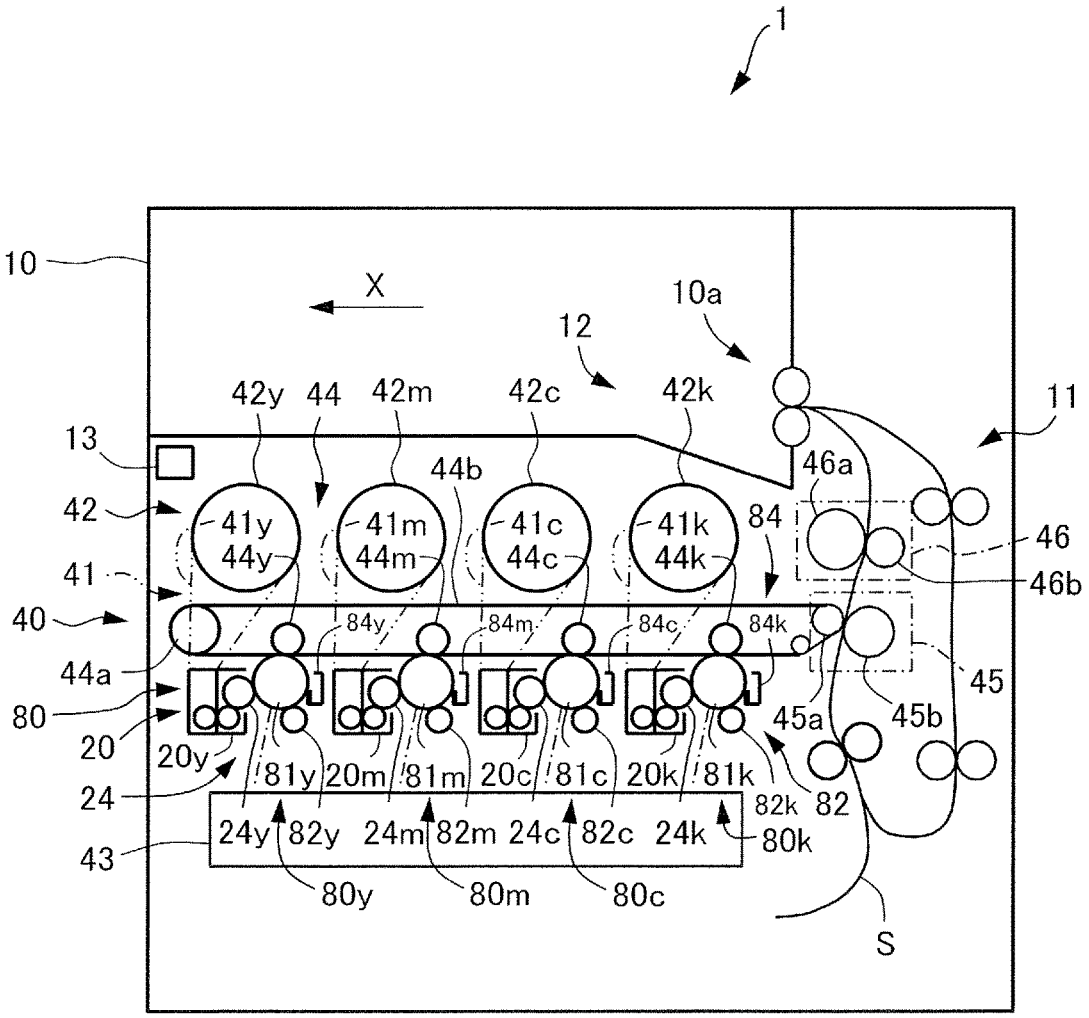
FIG. 1 is a section view of an image forming apparatus according to an exemplary embodiment illustrating a schematic configuration thereof.

An image forming apparatus 1 of an exemplary embodiment of the present invention will be described in detail below with reference to FIGS. 1 to 5A. To be noted, in the present exemplary embodiment, a case where the present invention is applied to a full-color printer of a tandem type serving as an example of the image forming apparatus 1 is described. To be noted, embodiments of the present invention are not limited to an image forming apparatus of a tandem type, and the present invention may be applied to image forming apparatuses of other types. In addition, the image forming apparatus is not limited to a full-color image forming apparatus, and may be a monochromatic image forming apparatus. Alternatively, the present invention may be implemented in a printer, various printing machines, a copier, a facsimile machine, a multi-functional printer, and so forth for various purposes by adding devices, equipment, and housing structures required therefor. In the present exemplary embodiment, the image forming apparatus 1 includes an intermediate transfer belt 44*b*, and employs a system in which toner images of respective colors are transferred from photosensitive drums 81 onto the intermediate transfer belt 44*b* through primary transfer and then a composite toner image of the respective colors is collectively transferred onto a sheet S through secondary transfer. However, the system employed by the image forming apparatus 1 is not limited to this, and a system of directly transferring toner images from photosensitive drums onto a sheet conveyed by a sheet conveyance belt may be employed. In the present exemplary embodiment, two-component developer constituted by nonmagnetic toner and magnetic carrier is used as developer.

Toner

Toner having a weight average particle diameter of 4 μm to 10 μm is preferable. In the present exemplary embodiment, toner for color copier having a weight average particle diameter of 6 μm is used. In the case where the weight average particle diameter of toner is represented by M and a particle diameter of toner is represented by r, it is preferable that particle diameters of toner particles of 90% by weight or more are in the range of $M/2<r<2M/3$ and particle diameters of toner particles of 99% by weight or more are in the range of $0<r<2M$ to form a clearer color image. Examples of binder resin used for the toner include polyester resin and styrene-based copolymer resin such as styrene-acrylic acid ester resin and styrene-methacrylic acid ester resin. Considering color blendability of color toner at the time of fixation, polyester resin is preferable because the polyester resin has a sharp melting property.

Carrier

Carrier preferably has an average particle diameter of 25 μm to 50 μm based on volume distribution. In the present exemplary embodiment, carrier having a volume average particle diameter of 35 μm is used. The volume average particle diameter is also referred to as a 50% particle diameter D50. In the description below, a particle diameter of carrier refers to a volume average particle diameter unless otherwise described explicitly. As such carrier particles, ferrite particles with or without thin resin coating thereon can be preferably used. Examples of the ferrite particles include Cu—Zn ferrite particles having a maximum magnetization of about 230 emu/cm$^3$. The average particle diameter based on volume distribution, that is, the 50% particle diameter D50 of the carrier is measured by using, for example, a multi-image analyzer manufactured by Beckman Coulter, Inc.

As the carrier, magnetic resin carrier constituted by binder resin and magnetic metal oxide, nonmagnetic metal oxide, or the like may be used. The magnetic resin carrier is characterized by having a maximum magnetization of about 190 emu/cm$^3$, which is smaller than the maximum magnetization of the ferrite particles. Therefore, magnetic interaction between adjacent magnetic brushes is smaller, and, as a result, naps of the magnetic brushes are more densely packed and shorter. Thus, an image of a higher resolution with less uneven brushing marks or the like can be provided.

As illustrated in FIG. 1, the image forming apparatus 1 includes an image forming apparatus body 10 serving as a housing. The image forming apparatus body 10 will be hereinafter referred to as an apparatus body 10. The apparatus body 10 includes an unillustrated image reading portion, an unillustrated sheet feeding portion, an image forming portion 40, a sheet conveyance portion 11, a sheet discharge portion 12, and a controller 13. To be noted, a toner image is to be formed on a sheet S serving as a recording material. Specific examples of the sheet S include plain paper sheets, resin sheets serving as substitutes for the plain paper sheets, cardboards, and sheets for an overhead projector.

The image forming portion 40 includes image forming units 80, toner hoppers 41, toner containers 42, a laser scanner 43, an intermediate transfer unit 44, a secondary transfer portion 45, and a fixing unit 46. The image forming portion 40 is capable of forming an image on a sheet S on the basis of image information. To be noted, the image forming apparatus 1 of the present exemplary embodiment is a full-color printer, and image forming units 80*y*, 80*m*, 80*c*, and 80*k* are respectively provided for four colors of yellow, magenta, cyan, and black. Here, y, m, c, and k respectively correspond to yellow, magenta, cyan, and black. The image forming units 80*y*, 80*m*, 80*c*, and 80*k* are separate image forming units that have similar configurations. Similarly, toner hoppers 41*y*, 41*m*, 41*c*, and 41*k*, and toner containers 42*y*, 42*m*, 42*c*, and 42*k* are respectively provided for the four colors of, yellow, magenta, cyan, and black. The toner hoppers 41*y*, 41*m*, 41*c*, and 41*k* are separate hoppers that have similar configurations, and the toner containers 42*y*, 42*m*, 42*c*, and 42*k* are separate containers that have similar configurations. Therefore, in FIG. 1, each component corresponding to each of the four colors is represented by adding an identifying letter at the end of the reference sign thereof. However, description may be given with only the reference sign without the identifying letter in FIG. 2 and the specification.

The toner containers 42 are, for example, bottles of cylindrical shapes, accommodate toner, and are disposed above the respective image forming units 80 so as to be coupled to the image forming units 80 via the toner hoppers 41. The laser scanner 43 exposes the surfaces of photosensitive drums 81 charged by charging rollers 82, and thus forms electrostatic latent images on the surfaces of the photosensitive drums 81.

The image forming units 80 include the four image forming units 80*y*, 80*m*, 80*c*, and 80*k* for forming toner images of four colors. The image forming units 80 each include a photosensitive drum 81, a charging roller 82, a developing unit 20, and a cleaning blade 84. The photosensitive drum 81 moves while carrying a toner image, and serves as an image bearing member. The photosensitive drums 81, the charging rollers 82, the developing units 20, the cleaning blades 84, and developing sleeves 24 that will be described later are also respectively provided separately in similar configurations for the four colors of yellow, magenta, cyan, and black.

The photosensitive drum 81 includes a photosensitive layer formed to have a negative charging polarity on the outer circumferential surface of an aluminum cylinder, and rotates at a predetermined process speed that is a peripheral speed. The charging roller 82 comes into contact with the surface of the photosensitive drum 81 and charges the surface of the photosensitive drum 81 to, for example, a uniform dark potential of a negative polarity. After charging the surface of the photosensitive drum 81, an electrostatic latent image is formed on the surface of the photosensitive drum 81 by the laser scanner 43 on the basis of image information. The photosensitive drum 81 rotationally moves while carrying the electrostatic latent image that has been formed, and the electrostatic latent image is developed with toner by the developing unit 20. The detailed configurations of the photosensitive drum 81 and the developing unit 20 will be described later.

The toner image that has been formed is transferred onto the intermediate transfer belt 44*b* that will be described later through primary transfer. After the primary transfer, the charge on the surface of the photosensitive drum 81 is removed by a pre-exposing portion that is not illustrated. The cleaning blade 84 is disposed in contact with the surface of the photosensitive drum 81, and cleans residual matter such as transfer residual toner remaining on the surface of the photosensitive drum 81 after primary transfer.

The intermediate transfer unit 44 is disposed above the image forming units 80*y*, 80*m*, 80*c*, and 80*k*. The intermediate transfer unit 44 includes a plurality of rollers and the intermediate transfer belt 44*b* looped over these rollers. The plurality of rollers include a driving roller 44*a*, a driven roller, primary transfer rollers 44*y*, 44*m*, 44*c*, and 44*k*, and so forth. The primary transfer rollers 44*y*, 44*m*, 44*c*, and 44*k* are respectively disposed to oppose the photosensitive drums 81*y*, 81*m*, 81*c*, and 81*k*, and are in contact with the intermediate transfer belt 44*b*.

By applying a positively polarized transfer bias to the intermediate transfer belt 44*b* by the primary transfer rollers 44*y*, 44*m*, 44*c*, and 44*k*, negatively polarized toner images on the photosensitive drums 81*y*, 81*m*, 81*c*, and 81*k* are sequentially transferred onto the intermediate transfer belt 44*b* so as to be superimposed on one another. In this manner, the toner images obtained by developing the electrostatic latent images on the surfaces of the photosensitive drums 81*y*, 81*m*, 81*c*, and 81*k* are transferred onto and moved by the intermediate transfer belt 44*b*.

The secondary transfer portion 45 includes a secondary transfer inner roller 45*a* and a secondary transfer outer roller 45*b*. By applying a positively polarized secondary transfer bias to the secondary transfer outer roller 45*b*, a full-color image formed on the intermediate transfer belt 44*b* is transferred onto the sheet S. The fixing unit 46 includes a fixing roller 46*a* and a pressurizing roller 46*b*. The sheet S is nipped and conveyed between the fixing roller 46*a* and the pressurizing roller 46*b*, and thus the toner image transferred onto the sheet S is heated and pressurized to be fixed on the sheet S.

The sheet conveyance portion 11 conveys the sheet S fed from the sheet feeding portion 30 to the sheet discharge portion 12 from the image forming portion 40. The sheet discharge portion 12 supports the sheet S discharged from the sheet conveyance portion 11 through a discharge port 10*a* in an arrow X direction.

The controller 13 is constituted by a computer, and includes, for example, a central processing unit: CPU, a read-only memory: ROM, a random access memory: RAM, and an input/output circuit. The ROM stores a program for controlling each portion, the RAM temporarily stores data, and a signal is input and output from and to the outside by the input/output circuit. The CPU is a microprocessor that manages overall control of the image forming apparatus 1, and is a main component of a system controller. The CPU is connected to the image reading portion, the sheet feeding portion, the image forming portion 40, the sheet conveyance portion 11, and an operation portion via the input/output circuit, and controls an operation by communicating signals with each portion.

Next, an image forming operation in the image forming apparatus 1 configured as described above will be described below.

In the case where the image forming operation is started, first, the photosensitive drums 81 rotate and the surfaces thereof are charged by the charging rollers 82. Then, laser light is emitted to the photosensitive drums 81 by the laser scanner 43 on the basis of image information, and thus electrostatic latent images are formed on the surfaces of the photosensitive drum 81. Toner attaches to these electrostatic latent images, and thus the electrostatic latent images are developed and visualized as toner images. Then, the toner images are transferred onto the intermediate transfer belt 44*b*.

Meanwhile, in parallel with this toner image forming operation, the sheet feeding portion operates and the sheet S is conveyed to the secondary transfer portion 45 at a timing matching conveyance of the toner images on the intermediate transfer belt 44*b*. Then, the toner images are transferred from the intermediate transfer belt 44*b* onto the sheet S, the sheet S is conveyed to the fixing unit 46, and the unfixed toner images are heated, pressurized, and thus fixed onto the surface of the sheet S. Thereafter, the sheet S is discharged through the discharge port 10*a* and supported on the sheet discharge portion 12.

Developing Unit

Next, the developing units 20 will be described in detail with reference to FIG. 2. The developing units 20 each include a developing container 21 that accommodates developer, a first conveyance screw 22, a second conveyance screw 23, a developing sleeve 24, and a regulation member 25. The developing container 21 includes an opening portion 21*a* through which the developing sleeve 24 is exposed at a position opposing the photosensitive drum 81.

Toner is supplied to the developing container 21 from the toner container 42 filled with toner and illustrated in FIG. 1. The developing container 21 includes, at approximately the center thereof, a partition wall 27 extending in a longitudinal direction. The developing container 21 is divided into a developing chamber 21*b* and an agitation chamber 21*c* in the horizontal direction by the partition wall 27. Developer is accommodated in the developing chamber 21*b* and the agitation chamber 21*c*. The developer is supplied to the developing sleeve 24 from the developing chamber 21*b*. The agitation chamber 21*c* communicates with the developing chamber 21*b*, collects developer from the developing sleeve 24, and agitates the developer.

The first conveyance screw 22 is disposed, in the developing chamber 21*b*, approximately parallel to the developing sleeve 24 along the axial direction of the developing sleeve 24, and agitates and conveys the developer in the developing chamber 21*b*. The second conveyance screw 23 is disposed, in the agitation chamber 21*c*, approximately parallel to the shaft of the first conveyance screw 22, and conveys the developer in the agitation chamber 21*c* in a direction opposite to the direction in which the first conveyance screw 22 conveys the developer. That is, the developing chamber 21*b* and the agitation chamber 21*c* constitute a circulation path of developer in which the developer is agitated and conveyed. The toner is agitated by the screws 22 and 23, and is thus charged to a negative polarity as a result of being rubbed against the carrier.

The developing sleeve 24 serving as a developer bearing member is rotatably provided to be capable of moving while carrying developer including nonmagnetic toner and magnetic carrier, and thus conveying the developer to a developing region Da opposing the photosensitive drum 81 to develop the electrostatic latent image formed on the photosensitive drum 81. Here, a region where magnetic brushes formed by carrier on the surface of the developing sleeve 24 come into contact with the photosensitive drum 81 is a contact nip, and this contact nip is regarded as the developing region Da in the present exemplary embodiment. That is, the developing region Da is a region where magnetic brushes carried on the developing sleeve 24 come into contact with the photosensitive drum 81.

For example, the developing sleeve 24 has a cylindrical shape with a diameter of 18 mm, and is formed from a nonmagnetic material such as aluminum, nonmagnetic stainless steel, or the like. In the present exemplary embodiment, the developing sleeve 24 is formed from aluminum. In addition, in the present exemplary embodiment, the smallest gap in the developing region Da is about 260 μm. In the present exemplary embodiment, in the developing region Da, the developing sleeve 24 rotates in a rotation direction R1, which is a same rotation direction R2 of the photosensitive drum 81, at a peripheral speed of Vs=491.4 mm/sec. The movement speed of the developing sleeve 24 is faster than the movement speed of the photosensitive drum 81, and the peripheral speed rate thereof with respect to the photosensitive drum 81 is 1.8. That is, Vs/Vdr=1.8 is satisfied. In a developing system in which two-component developer is used, at the time of development, magnetic carrier is bound by a magnetic flux of a magnet roller 24*m* and carried on the surface of the developing sleeve 24.

The developing sleeve 24 is connected to a direct current power source 28 that applies a direct current voltage as a developing bias voltage. On the surface of the developing sleeve 24, toner charged to a negative polarity is electrostatically bound on the surface of carrier charged to a positive polarity, and thus magnetic brushes are formed. By providing a potential difference between the direct current voltage applied to the developing sleeve 24 and the electrostatic latent image on the photosensitive drum 81, toner is caused to fly toward the photosensitive drum 81, and thus the electrostatic latent image is turned into a visible image.

A developing process on the photosensitive drum 81 with toner in the developing region Da is as follows. First, the photosensitive drum 81 is uniformly charged to a charging potential Vd [V] by the charging roller 82, and then the potential of an image portion is changed to an exposure potential Vl [V] as a result of being exposed by the laser scanner 43. A developing bias in which a direct current voltage and an alternate current voltage are superimposed is normally applied to the developing sleeve 24 to improve the attachment rate of toner to the electrostatic latent image. However, in the present exemplary embodiment, a DC development system in which an alternate current voltage is not applied and only a direct current voltage from a direct current power source is applied is employed. That is, the developing unit 20 applies a direct current voltage to the developing sleeve 24 as a developing bias without using an alternate current voltage, and thus develops the electrostatic latent image formed on the photosensitive drum 81 with toner. In the case where Vdc represents voltage of a direct current component of the developing sleeve 24, an absolute value |Vdc−Vl| of difference from the exposure potential is referred to as Vcont, and this forms an electric field for conveying the toner to an image portion. To be noted, an absolute value |Vdc−Vd| of difference between the direct current voltage Vdc and the charging potential Vd is referred to as Vback, and this forms an electric field for drawing toner back from the photosensitive drum 81 toward the developing sleeve 24. This is provided to suppress a so-called fogging phenomenon in which toner attaches to a non-image portion.

The regulation member 25 is provided in the developing container 21 to oppose a regulation pole N1 of the magnet roller 24*m*. The regulation member 25 is fixed to the developing container 21 in a state where a predetermined gap is provided between a distal end portion of the regulation member 25 and the developing sleeve 24, and regulates the thickness of a layer of the developer carried on the surface of the developing sleeve 24 by cutting the magnetic brushes. The regulation member 25 is constituted by a nonmagnetic metal plate disposed in an axial direction W of the developing sleeve 24, and the developer passes between the distal end portion of the regulation member 25 and the developing sleeve 24 and is delivered to the developing region Da. The regulation member 25 is constituted by, for example, an aluminum plate. In the present exemplary embodiment, the thickness of the regulation member 25 is set to 1.2 mm.

By adjusting the gap between the distal end portion of the regulation member 25 and the surface of the developing sleeve 24, the amount of developer carried by the developing sleeve 24 and conveyed to the developing region Da is adjusted. In the present exemplary embodiment, the amount of developer coating the developing sleeve 24 per unit area is adjusted to 0.3 $mg/mm^2$=30 $mg/cm^2$. From the viewpoint of graininess of an image, it is preferable that the amount of developer per unit area after passing by the regulation member 25 is set to be within the range of 0.3±0.2 $mg/mm^2$=30±20 $mg/cm^2$. In addition, it is preferable that the gap between the regulation member 25 and the developing sleeve 24 at this time is 0.2 mm or larger. This is because, in the case where the gap between the regulation member 25 and the developing sleeve 24 is small, the gap is likely to be clogged by foreign matter or the like, and this can affect the image.

The magnet roller 24*m* including a plurality of magnet poles on the surface thereof and unrotatably supported in the developing container 21 is disposed inside the developing sleeve 24. In the present exemplary embodiment, the magnet roller 24*m* includes a developing pole S2, a regulation pole N1, a conveyance pole N2, a peeling pole S3, and a draw-up pole S1. The developing pole S2 is disposed to oppose the photosensitive drum 81 in the developing region Da. The regulation pole N1 is disposed to oppose the regulation member 25. The draw-up pole S1 is disposed upstream of the regulation pole N1 in the rotation direction R1, and draws up the developer from the developing chamber 21*b*. The peeling pole S3 is disposed upstream of the draw-up pole S1 in the rotation direction R1, generates a repulsive magnetic field between the peeling pole S3 and the draw-up pole S1, and peels off the developer between the peeling pole S3 and the draw-up pole S1. The conveyance pole N2 is disposed between the developing pole S2 and the peeling pole S3. The magnetic flux densities of the magnetic poles are set in the range of 40 mT to 100 mT.

Figure 3A:
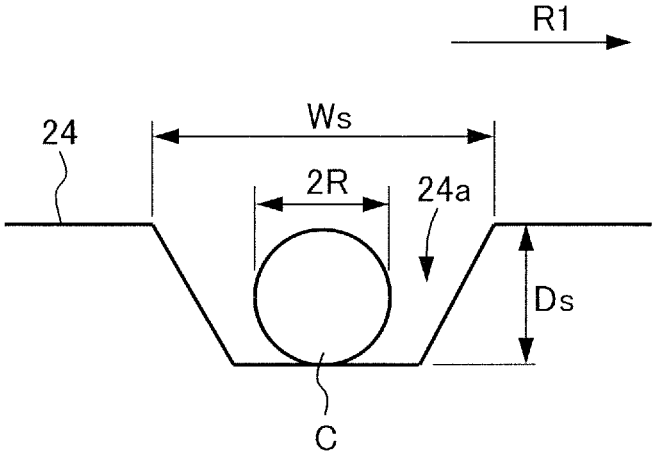
FIG. 3A and FIG. 3B are enlarged section views of a surface portion of a developing sleeve, FIG. 3A illustrating a case where the width and the depth of a groove portion is larger than the diameter of carrier, and FIG. 3B illustrating a case where the width and the depth of the groove portion is smaller than the diameter of the carrier.

Groove portions 24*a* having groove shapes recessed with respect to the surface of the developing sleeve 24 along the axial direction W of the developing sleeve 24 are defined on the surface of the developing sleeve 24 as illustrated in FIG. 3A. The groove portions 24*a* serve as second recess portions. The groove portions 24*a* are grooves extending in the axial direction W of the developing sleeve 24. The groove portions 24*a* are periodically provided at equal intervals in the circumferential direction. The developing sleeve 24 including these groove portions 24*a* has a more stable performance of conveying the developer than another developing sleeve such as a developing sleeve subjected to alundum blasting. On the other hand, in the case of using the developing sleeve 24 including these groove portions 24*a*, there is a possibility that periodical unevenness occurs in the conveyance state of the developer of the developing sleeve 24 due to the pitch of the periodical recesses of the groove portions 24*a*. That is, in the groove portions 24*a*, the developer is likely to be caught and concentrated. As a result of this, more developer is present at a part corresponding to the groove portions 24*a* and less developer is present at a smooth part where the groove portions 24*a* are not present. At a portion at which the developer comes into contact with the photosensitive drum 81, that is, a center portion of a so-called developing nip, such difference is not likely to affect the shading. However, this has a greater influence in a circumstance in which the distance between the developing sleeve 24 and the photosensitive drum 81 is large and the intensity of electric field is small on the downstream side of the developing nip. As a result of this, at the time when the developer on the downstream side of the developing nip is separated from the photosensitive drum 81, the toner density increases at the part corresponding to the groove portions 24*a* where the amount of developer is large and the toner density decreases at the other part. Therefore, there is a possibility that the density unevenness corresponding to the period of the groove portions 24*a* may be visible in the image.

Therefore, in the present exemplary embodiment, the following configuration is employed. Generally, in the case where periodical density unevenness occurs, the visual sensitivity of a person visually recognizing the density unevenness differs depending on the pitch, and the visual sensitivity tends to drop when the spatial frequency is set to be larger than 1 line/mm. Therefore, in the configuration of the present exemplary embodiment, the pitch of the density unevenness in the visible image to be formed on the photosensitive drum 81 is set to be larger than 1 line/mm. Therefore, the pitch of the groove portions 24*a* in the movement direction, that is, the rotation direction R1, is set to be within a first range.

In the present exemplary embodiment, the diameter of the developing sleeve 24 is 18 mm. In addition, 72 lines of the groove portions 24*a* are arranged on the surface of the developing sleeve 24 at substantially equal intervals. The number of these lines is the number of lines present on the same circumference. At this time, a second pitch between adjacent groove portions 24*a* is Ps=18×3.14/72=0.785 mm. The pitch is calculated by dividing the circumferential length by the number of lines. The developing sleeve 24 rotates at a peripheral speed 1.8 times as fast as the peripheral speed of the photosensitive drum 81. Therefore, in the case where the density unevenness of the period of the adjacent groove portions 24*a* appears as density unevenness on the photosensitive drum 81, the pitch of the density unevenness is Ps/(Vs/Vdr)=0.785/1.8=0.436 mm. This corresponds to a spatial frequency Fs=1/Ps=about 2.3 lines/mm, which is sufficiently higher than 1 line/mm. That is, the pitch is preferably set such that Ps/(Vs/Vdr)<2 mm is satisfied, that is, Ps<2×(Vs/Vdr) mm is satisfied. More preferably, the pitch is set such that Ps/(Vs/Vdr)<1 mm is satisfied, that is, Ps<Vs/Vdr mm is satisfied. That is, the upper limit of the first range in which the pitch of the groove portions 24*a* is set is Vs/Vdr mm. Meanwhile, in the case where the pitch is too small, the recesses of the surface become finer and steeper, and thus the groove portions 24*a* become more likely to be clogged by toner, and thus there is a risk that toner or the like is fused and adheres thereto. Therefore, the lower limit of the first range in which the pitch of the groove portions 24*a* is set is preferably set to be 0.01 mm or larger, that is, such that Ps≥0.01×(Vs/Vdr) mm is satisfied. As described above, the first range is 0.01×(Vs/Vdr) mm≤Ps<Vs/Vdr mm.

Figure 3B:
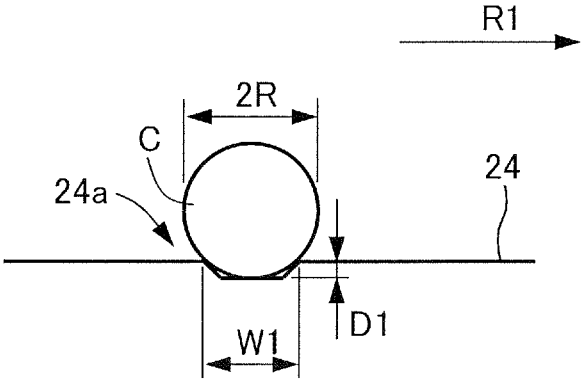

As illustrated in FIG. 3A, the sectional shape of a groove portion 24*a* of the developing sleeve 24 taken along a line perpendicular to the rotation axis thereof is approximately trapezoidal. The developer needs to be caught in the groove portion 24*a* to stabilize the developer coating state, and the carrier, which conveys the developer, needs to be caught in the groove portion 24*a* for the developer to be caught in the groove portion 24*a*. For carrier C in the developer to be caught in the groove portion 24*a*, it is preferable that a width Ws, or length, of the groove portion 24*a* is larger than a particle diameter 2R of the carrier C. As illustrated in FIG. 3B, in the case where a width W1 of the groove portion 24*a* is smaller than the diameter 2R of the carrier C, the carrier C is not fully accommodated in the groove portion 24*a*, and thus the carrier C is less likely to be caught in the groove portion 24*a*. Further, as illustrated in FIG. 3A, in the case where a groove depth Ds is larger than a radius R of the carrier C, the carrier C is more likely to be caught in the groove portion 24*a*. As illustrated in FIG. 3B, in the case where a groove depth D1 is smaller than the radius R of the carrier C, the carrier C is less likely to be caught in the groove portion 24*a*. In the present exemplary embodiment, the diameter 2R of the carrier C is 40 and therefore the width Ws of the groove portion 24*a* is set to 135 μm and the depth Ds of the groove portion 24*a* is set to 40 μm to satisfy the conditions described above.

To be noted, the shape and dimensions of the groove portion 24*a* of the developing sleeve 24 are of course not limited to the shape and dimensions described above. For example, although the sectional shape of the groove portion 24*a* has been described as a trapezoidal shape in the present exemplary embodiment, the sectional shape may be another shape such as a V shape. In addition, the width Ws of the groove portion 24*a* of the present exemplary embodiment refers to the width, or length, in the rotation direction of the developing sleeve 24 of a portion of the developing sleeve 24 where the groove portion 24*a* is defined. To be noted, there is a case where an edge portion of a groove portion becomes dull to some extent and the width of the groove portion 24*a* becomes unclear compared with a case where the edge portion has an angle. In this case, considering the gist of the present invention, the dull portion does not have to be included in the width of the groove portion 24*a*.

Photosensitive Drum

Next, the photosensitive drum 81 will be described in detail. In the present exemplary embodiment, the photosensitive drum 81 is an organic photosensitive member including an organic photosensitive layer including a plurality of layers having separate functions. The photosensitive drum 81 has a layer structure in which a conductive layer, an undercoat layer, a charge generation layer, a charge transfer layer, and a protective layer are laminated in this order from the bottom to the top on the circumferential surface of a support body constituted by an aluminum tube or the like. To be noted, among the layers described above, the layers other than the conductive layer are collectively referred to as a photosensitive layer. The photosensitive drum 81 has a diameter of 30 mm, and rotates in the rotation direction R2 at a process speed, which is a peripheral speed, of Vdr=273 mm/sec.

Figure 4A:
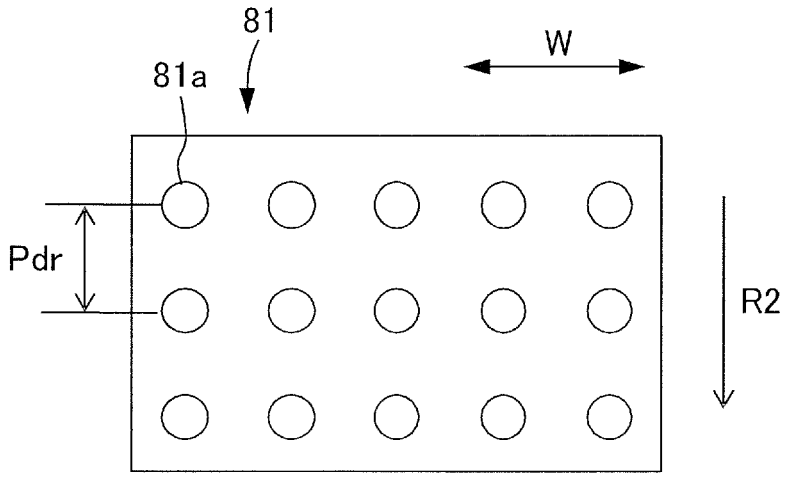
FIGS. 4A and 4B are enlarged views of the surface portion of the photosensitive drum according to the exemplary embodiment, FIG. 4A illustrating a case where recess portions are arranged in a grid pattern in a rotation direction and in an axial direction, and FIG. 4B illustrating a case where further a recess portion is disposed at the center of each square of the grid pattern in the arrangement illustrated in FIG. 4A.

As illustrated in FIG. 4A, a plurality of separate recess portions 81*a* serving as first recess portions are periodically defined on the photosensitive drum 81 so as to be recessed with respect to the surface of the photosensitive drum 81. By providing the plurality of recess portions 81*a* on the surface of the photosensitive drum 81, chattering between the photosensitive drum 81 and the cleaning blade 84 can be appropriately suppressed. A method of forming the surface of the photosensitive drum 81 will be described herein. To define the plurality of recess portion 81*a* on the surface of the photosensitive drum 81, a pressure contact shape transfer process using a mold is used. In the pressure contact shape transfer process, the mold is continuously in contact with the circumferential surface of the photosensitive drum 81 to pressurize the circumferential surface while rotating the photosensitive drum 81. Thus, the recess portions 81*a* and a smooth portion can be defined on the surface of the photosensitive drum 81. In the present exemplary embodiment, the recess portions 81*a* each has a closed-end circular hole shape having a depth of Ddr=1 μm and a diameter of 20 μm, and the recess portions 81*a* are substantially periodically provided in the rotation direction R2 with a first pitch Pdr. The shape and dimensions of the recess portions 81*a* are of course not limited to the shape and dimensions described above. In addition, in the case where the recess portions 81*a* do not have circular shapes, it is preferable that a long axis length referring to the length of the longest straight line crossing the opening is larger than 3.0 μm and smaller than 14.0 μm. The diameter or the long axis length described above can be measured as an average value obtained by statistical processing of sizes of recess portions in a 100 μm×100 μm area. In addition, the depth of a recess portion is preferably 0.1 μm or larger, and is more preferably 0.5 μm or larger. The depth can be measured as an average value obtained by statistical processing of sizes of recess portions in a 100 μm×100 μm area.

There is a possibility that these periodical recess portions 81*a* of the photosensitive drum 81 also cause the periodical density unevenness to be visible in the image as in the case of the developing sleeve 24 described above. Some can be considered as causes for the occurrence of the density unevenness, and specific one of these is change in the charging potential caused by difference in the way in which the charging roller 82 is in contact with the photosensitive drum 81 between the recess portions 81*a* and the smooth portion. In addition, there is also a case where the density unevenness occurs due to change in capacitance caused by the difference in the layer thickness of the photosensitive layer of the photosensitive drum 81 between the recess portions 81*a* and the smooth portion. In the case of the photosensitive drum 81, similarly to the case of the groove portions 24*a* of the developing sleeve 24 described above, the periodical density unevenness can be made less visible by reducing the pitch Pdr of the recess portions 81*a* of the photosensitive drum 81 in the rotation direction R2 as much as possible.

The pitch of the recess portions 81*a* present on the same circumference in the rotation direction R2 that is the movement direction is set to be within a second range. Here, by setting a frequency Fdr=1/Pdr of the recess portions 81*a* to be higher than 1 line/mm, that is, by setting Pdr to be smaller than 1 mm, the periodical density unevenness can be made less visible, and thus the upper limit of the second range in which the pitch of the recess portions 81*a* is set is 1 mm.

Figure 4B:
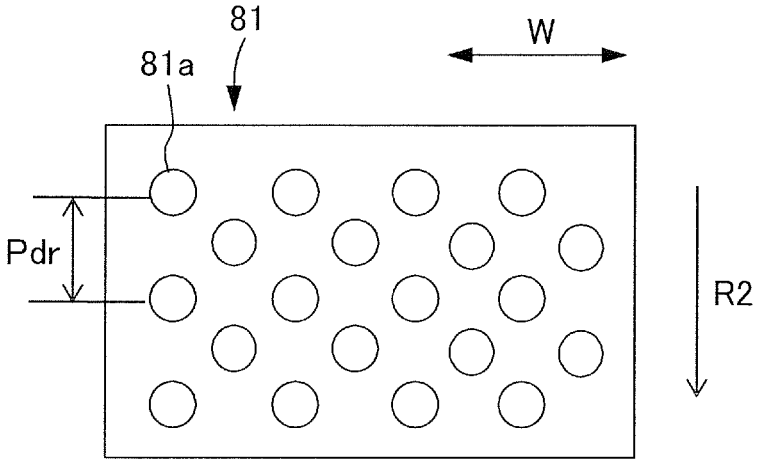

More preferably, the upper limit is 0.2 mm. Meanwhile, in the case where the pitch is too small, the recesses of the surface become finer and steeper, and thus the recesses become more likely to be clogged by toner, and thus there is a risk that toner or the like is fused and adheres thereto. Therefore, the lower limit of the second range in which the pitch of the recess portions 81*a* is set is preferably set to be 0.01 mm or larger, that is, such that Pdr≥0.01 mm is satisfied. That is, the second range is 0.01 mm≤Pdr<1 mm. More preferably, the second range is 0.01 mm≤Pdr<0.2 mm. In the present exemplary embodiment, for example, Pdr is set to 0.03 mm. In addition, the recess portions 81*a* are arranged in a grid pattern with respectively predetermined pitches in the rotation direction R1 and the axial direction W. However, the arrangement is not limited to this, and, for example, a recess portion 81*a* may be further disposed at the center of each square of the arrangement illustrated in FIG. 4A as illustrated in FIG. 4B. In the present exemplary embodiment, the pitch is an average value obtained by statistical processing of pitches of recess portions present on the same circumference in a 100 μm×100 μm area. To be noted, the shape, length, and pitch of recess portions on the surface of an electrophotographic photosensitive member can be measured by using, for example, a laser microscope, an optical microscope, an electron microscope, or an atomic force microscope that is commercially available. As the laser microscope, for example, the following can be used: 3D laser scanning microscope VK-8550, VK-9000, and VK-9500 manufactured by KEYENCE Corporation; a surface profile measurement system Surface Explorer SX-520DR manufactured by Mitsubishi Chemical Systems, Inc.; a confocal laser scanning microscope OLS3000 manufactured by Olympus Corporation; and a real color confocal microscope OPIELICS C130 manufactured by Lasertec Corporation. As the optical microscope, for example, the following can be used: digital microscopes VHX-500 and VHX-200 manufactured by KEYENCE Corporation; and a 3D digital microscope VC-7700 manufactured by OMRON Corporation. As the electron microscope, for example, the following can be used: 3D real surface view microscopes VE-9800 and VE-8800 manufactured by KEYENCE Corporation; a conventional/variable pressure scanning electron microscope manufactured by SII nanotechnologies; and a scanning electron microscope SUPERSCAN SS-550 manufactured by SHIMADZU Corporation. By using the microscope described above at a certain magnification, the number, long axis lengths, and depths of recess portions in a measurement range can be measured. Further, the average long axis length, the average depth, and the pitch of the recess portions per unit area can be obtained by calculation. An example of measurement performed by using an analysis program of Surface Explorer SX-520DR will be described. An electrophotographic photosensitive member to be measured is placed on a workpiece placing stage, the horizontalness is adjusted by tilt adjustment, and 3D shape data of the circumferential surface of the electrophotographic photosensitive member is obtained by a wave mode. At this time, the magnification of the objective lens is set to 50 times, and observation may be made in a 100 μm×100 μm (10000 $\mu m^2$) area. In this method, measurement is performed by providing a 100 μm×100 μm square region in each of 100 regions obtained by equally dividing the surface of the photosensitive member to be measured into 4 regions in the rotation direction of the photosensitive member and further equally dividing each of the 4 regions into 25 regions in a direction perpendicular to the rotation direction of the photosensitive member. Next, contour data of the surface of the electrophotographic photosensitive member is displayed by using a particle analysis program in data analysis software. Hole analysis parameters of a recess portion such as the shapes, long axis lengths, depths, and pitch of the recess portions can be respectively optimized in accordance with the recess portions that have been defined. For example, in the case of observing and measuring recess portions having long axis lengths of about 10 μm, the upper limit of the long axis length may be set to 15 μm, the lower limit of the long axis length may be set to 1 μm, the lower limit of the depth may be set to 0.1 μm, and the lower limit of the volume may be 1 $\mu m^3$ or more. In addition, the number of recess portions that can be identified as recess portions on an analysis screen is counted, and the counted value is used as the number of recess portions.

In the case where development is performed on the photosensitive drum 81 provided with the periodical recess portions 81*a* by using the developing sleeve 24 provided with the periodical groove portions 24*a*, there is a possibility that beat occurs between the periods of these two, thus a large periodical density unevenness occurs, and the visibility of the density unevenness increases. First, the developing region Da in the case where the pitch Pdr of the recess portions 81*a* of the photosensitive drum 81 is larger than Ws/(Vs/Vdr) where Ws/(Vs/Vdr) represents the width of a groove portion 24*a* of the developing sleeve 24 as illustrated in FIG. 5B, that is, in the case where Pdr>Ws/(Vs/Vdr) is satisfied will be described. To be noted, in FIG. 5B, since the peripheral speed of the developing sleeve 24 is faster than the peripheral speed of the photosensitive drum 81, the widths of the groove portions 24*a* and the intervals between the groove portions 24*a* are illustrated by correcting the intervals by using the peripheral speed rate. In addition, in FIG. 5B, overlapping portions A1 between the groove portions 24*a* and the recess portions 81*a* appear at every other groove portion 24*a*. In this case, although not all the groove portions 24*a* and the recess portions 81*a* overlap one another, the groove portions 24*a* and the recess portions 81*a* overlap periodically. This causes beat, and, as a result of this, a large density unevenness occurs in the circumferential direction and the visibility is degraded.

The present inventors have conducted intensive study on this problem, and have conceived the dimensions and shapes of the groove portions 24*a* of the developing sleeve 24 and the recess portions 81*a* of the photosensitive drum 81 to solve the problem described above. First, beat occurs as a result of the print density of the visible image on the photosensitive drum 81 being increased and decreased at certain intervals in the developing region Da due to the groove portions 24*a* of the developing sleeve 24. In the case where beat occurs, since the frequency of the beat is lower than the frequency of the groove portions 24*a* of the developing sleeve 24, the frequency of the density unevenness becomes lower than 1 line/mm and the density unevenness becomes more visible. Therefore, in order not to cause the beat, a configuration in which the groove portions 24*a* of the developing sleeve 24 always contribute to constructive interference is needed. The periodical density unevenness caused by the groove portions 24*a* of the developing sleeve 24 occurs as a result of the developer concentrating at the groove portions 24*a* and the density of the part corresponding to the groove portions 24*a* increasing at the time of release of developer on the downstream side of the developing nip. Beat occurs in the case where the recess portions 81*a* of the photosensitive drum 81 oppose and overlap this part corresponding to the groove portions 24*a*. Therefore, in order not to cause the beat, a configuration in which the part corresponding to the groove portions 24*a* of the developing sleeve 24 always overlap the recess portions 81*a* of the photosensitive drum 81 may be employed. That is, the groove portions 24*a* of the developing sleeve 24 may be caused to always oppose the recess portions 81*a* of the photosensitive drum 81 in the developing region Da while moving the groove portions 24*a* and the recess portions 81*a*.

The developing sleeve 24 rotates at a peripheral speed rate of Vs/Vdr=1.8 with respect to the photosensitive drum 81. Therefore, a part on the photosensitive drum 81 corresponding to the groove portions 24*a* of the developing sleeve 24 is contracted to be 1/1.8 in size. Since the width of a groove portion 24*a* on the developing sleeve 24 is Ws=135 μm, the width corresponding to the groove portion 24*a* on the photosensitive drum 81 is Ws/(Vs/Vdr)=(135 μm)/(1.8)=75 μm. For a configuration in which the groove portions 24*a* always oppose the whole of a recess portion 81*a* of the photosensitive drum 81, the pitch Pdr of the recess portions 81*a* of the photosensitive drum 81 may be 75 μm or smaller. That is, the pitch Pdr of the recess portions 81*a* of the photosensitive drum 81 in the rotation direction R2 may be smaller than (width Ws of the groove portion 24*a* of the developing sleeve 24)/(peripheral speed rate of the developing sleeve 24). By satisfying Pdr<Ws/(Vs/Vdr), that is, Vs/Vdr<Ws/Pdr, the beat can be suppressed.

Figure 5A:
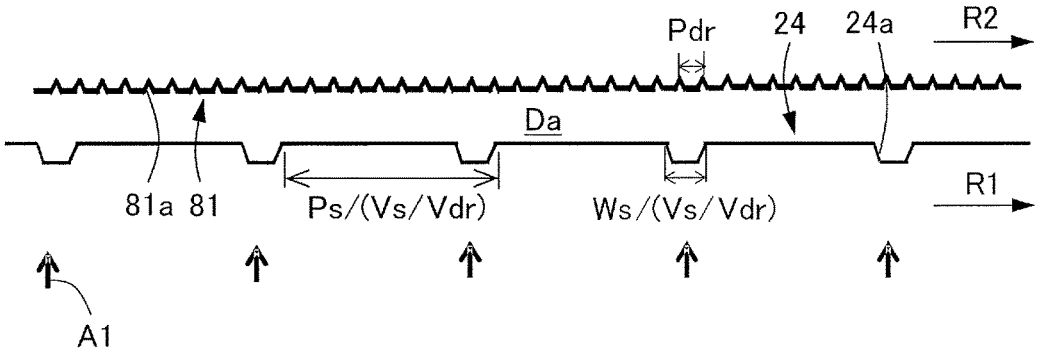
FIGS. 5A and 5B are schematic diagrams illustrating states in which the developing sleeve and the photosensitive drum are opposed to each other in a developing region, FIG. 5A illustrating a case of the image forming apparatus according to the exemplary embodiment, and FIG. 5B illustrating an image forming apparatus of a comparative embodiment.
Figure 5B:
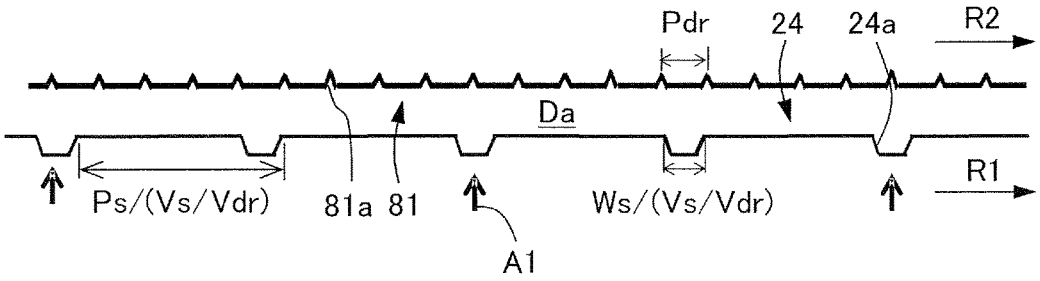

FIG. 5A illustrates the photosensitive drum 81 and the developing sleeve 24 in the case where (the pitch of recess portions of the photosensitive drum)<(the width of a groove portion of the developing sleeve)/(the peripheral speed rate with respect to the photosensitive drum) is satisfied, that is, where Pdr<Ws/(Vs/Vdr) is satisfied in the present exemplary embodiment. In this case, the groove portions 24*a* always overlap the recess portions 81*a* in the developing region Da. In FIGS. 5A and 5B, overlapping portions are indicated by arrows A1. Since the overlapping portions A1 are generated with the same pitch as the pitch Ps of the groove portions 24*a* of the developing sleeve 24, the occurrence of low-frequency beat is suppressed, and thus the visibility of the periodical density unevenness can be reduced.

To be noted, there is a possibility that, depending on the shape of the recess portions 81*a*, overlapping becomes insufficient in the case where the recess portions 81*a* and the groove portions 24*a* oppose one another at end portions thereof. Therefore, in order to make the groove portions 24*a* always oppose the recess portions 81*a* not at the end portions thereof, the pitch Pdr of the recess portions 81*a* on the photosensitive drum 81 in the rotation direction may be smaller than Ws/(VsNdr)/1.5. That is, the pitch Pdr may be set such that Pdr<Ws/(VsNdr)/1.5 is satisfied, in other words, such that (Vs/Vdr)<(Ws/Pdr)/1.5 is satisfied. Further, in the case where the pitch Pdr is set such that Pdr<Ws/(Vs/Vdr)/2 is satisfied, in other words, such that (Vs/Vdr)<(Ws/Pdr)/2 is satisfied, one or more of the recess portions 81*a* of the photosensitive drum 81 can be made to fully overlap a part corresponding to each of the groove portions 24*a* of the developing sleeve 24. In this case, the occurrence of the low-frequency beat is more effectively suppressed, and thus the visibility of the periodical density unevenness can be suppressed.

By reducing the peripheral speed rate Vs/Vdr with respect to the photosensitive drum, the relationship represented by the expressions described above are more likely to be satisfied. However, if the peripheral speed rate is reduced too much, there is a possibility that the amount of developer supplied to the photosensitive drum 81 decreases and the development efficiency also decreases. Therefore, the peripheral speed rate Vs/Vdr with respect to the photosensitive drum is preferably set to 1.0 or greater, and more preferably to 1.35 or greater.

The pitch Ps of the groove portions 24*a* of the developing sleeve 24 is set such that the pitch on the photosensitive drum 81 corresponding to the pitch Ps of the groove portions 24*a* satisfies the relationship of Ps/(Vs/Vdr)<1 mm, and the pitch Pdr of the recess portions 81*a* of the photosensitive drum 81 in the rotation direction R2 satisfies Pdr<1 mm. This is a condition that guarantees that the visibility of the density unevenness is low in the first place in a state in which beat does not occur. In addition, in the case where Ps/(Vs/Vdr) is set to be a multiple of Pdr, the strength of constructive interference at all the groove portions 24*a* becomes substantially equal, and there is a possibility that the constructive interference becomes too strong in some cases. Therefore, the value of Ps/(Vs/Vdr) is preferably set not to be a multiple of Pdr, specifically not an integer multiple of Pdr.

Next, an operation of performing development on the photosensitive drum 81 by the developing unit 20 described above will be described.

Figure 2:
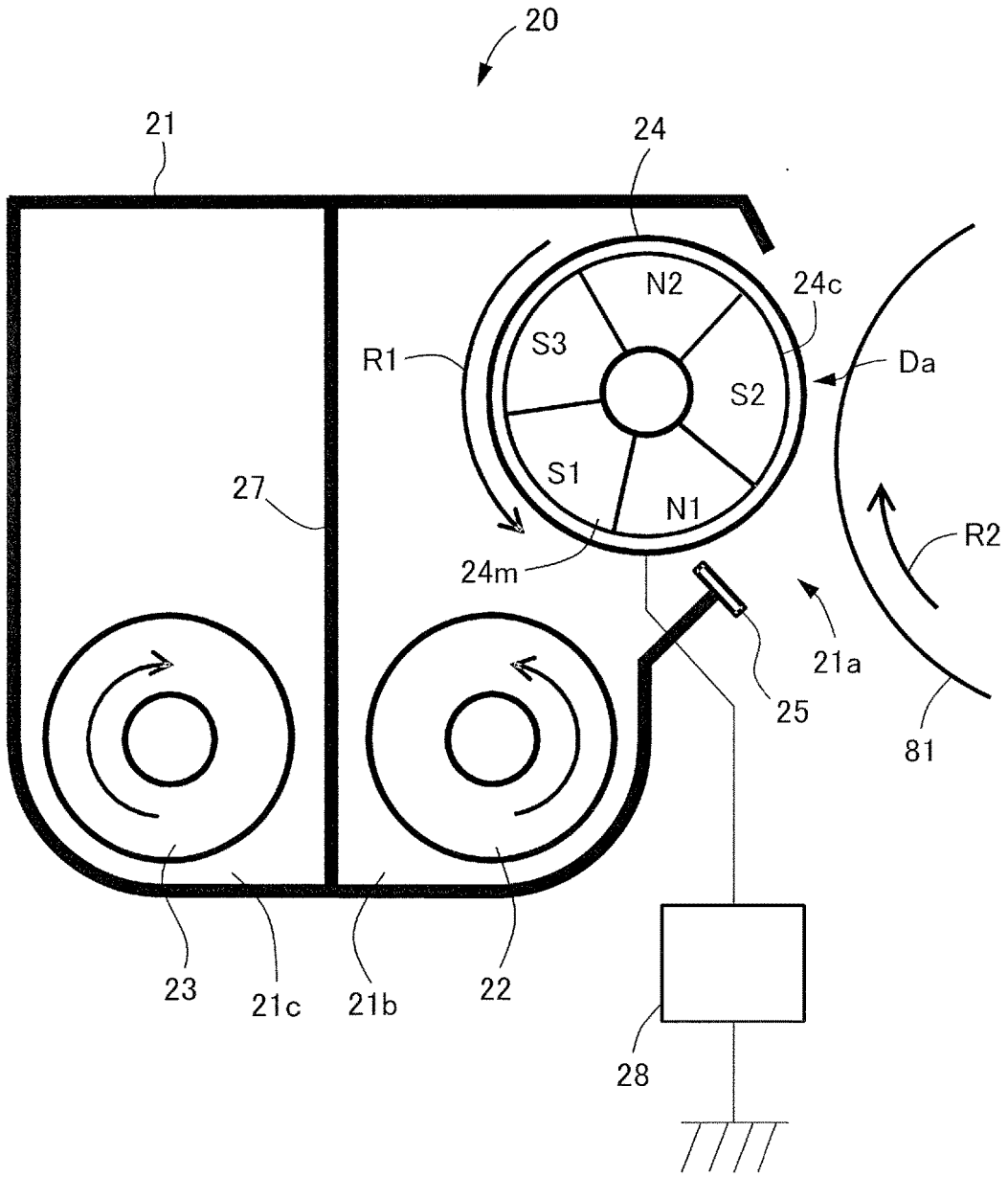
FIG. 2 is a section view of a developing unit according to the exemplary embodiment illustrating a schematic configuration thereof.

As illustrated in FIG. 2, the developer accommodated in the developing chamber 21*b* is agitated and conveyed by the conveyance screw 22, and is carried on the surface of the developing sleeve 24 by the magnetic force of the magnet roller 24*m*. As illustrated in FIG. 3A, on the surface of the developing sleeve 24, the carrier C is caught in the groove portions 24*a* and form magnetic brushes. The developing sleeve 24 rotates, the magnetic brushes come into contact with the photosensitive drum 81, and thus the electrostatic latent image on the photosensitive drum 81 is developed with toner. At this time, as illustrated in FIG. 5A, the groove portions 24*a* are disposed so as to be always opposed to the recess portions 81*a* in the developing region Da while moving the groove portions 24*a* of the developing sleeve 24 and the recess portions 81*a* of the photosensitive drum 81. Therefore, the beat caused by on and off overlapping of the groove portions 24*a* and the recess portions 81*a* does not occur, the occurrence of the low-frequency beat is suppressed, and thus the visibility of the periodical density unevenness can be suppressed.

As described above, according to the image forming apparatus 1 of the present exemplary embodiment, the pitch Pdr of the recess portions 81*a* of the photosensitive drum 81 is set to be smaller than the length Ws/(Vs/Vdr) on the visible image corresponding to the groove portions 24*a* of the developing sleeve 24. Therefore, the groove portions 24*a* always oppose the recess portions 81*a* and contribute to constructive interference to increase the print density, and therefore beat having a pitch equal to or larger than the pitch of the groove portions 24*a* of the developing sleeve 24 does not occur. As a result of this, in the case of performing development on the photosensitive drum 81 provided with the periodical recess portions 81*a* by using the developing sleeve 24 provided with the periodical groove portions 24*a*, the occurrence of density unevenness caused by the periodical beat between the groove portions 24*a* and the recess portions 81*a* can be suppressed.

In addition, according to the image forming apparatus 1 of the present exemplary embodiment, the value of Ps/(Vs/Vdr) is set not to be a multiple of Pdr. Therefore, a phenomenon of the constructive interference becoming too strong can be suppressed as compared with a case where the strength of constructive interference is substantially equal at all the groove portions 24*a* and the constructive interference becomes too strong as in the case where the value of Ps/(Vs/Vdr) is a multiple of Pdr.

In addition, according to the image forming apparatus 1 of the present exemplary embodiment, the DC development system in which only the direct current voltage from the direct current power source 28 is applied to the developing sleeve 24 is employed. Therefore, compared with the case where a developing bias in which an alternate current voltage is superimposed on a direct current voltage is applied, the fly of toner from the developing sleeve 24 to the photosensitive drum 81 can be suppressed, and the density unevenness caused by the periodical beat between the groove portions 24*a* and the recess portions 81*a* can be made less visible.

To be noted, although a case where the first recess portions provided on the developing sleeve 24 are the groove portions 24*a* having groove shapes has been described with regard to the image forming apparatus 1 of the present exemplary embodiment described above, the shape of the first recess portions is not limited to this. For example, recess portions of other shapes such as columnar shapes may be applied as the first recess portions of the developing sleeve 24. In addition, although a case where the second recess portions provided on the photosensitive drum 81 are the recess portions 81*a* having columnar shapes has been described with regard to the image forming apparatus 1 of the present exemplary embodiment described above, the shape of the second recess portions is not limited to this. For example, recess portions of shapes such as prismatic shapes or other shapes, or groove portions may be applied as the second recess portions of the photosensitive drum 81.

In addition, although the peripheral speed rate with respect to the photosensitive drum is set to 1.8 in the image forming apparatus 1 of the present exemplary embodiment, the peripheral speed rate with respect to the photosensitive drum may be changed as appropriate. Also in this case, the occurrence of the density unevenness caused by the periodical beat between the groove portions 24*a* and the recess portions 81*a* can be suppressed by setting the length Ws/(Vs/Vdr) on the visible image corresponding to the groove portions 24*a* to be smaller than the pitch Pdr of the recess portions 81*a*.

Next, by using the image forming apparatus 1 of the exemplary embodiment described above, the peripheral speed rate Vs/Vdr with respect to the photosensitive drum and the pitch Pdr of the recess portions 81*a* of the photosensitive drum 81 were changed. The width Ws and the pitch Ps of the groove portions 24*a* of the developing sleeve 24 were each set to be constant. In the image forming apparatus 1 satisfying the conditions, formation of an image having an optical density of about 0.6 was performed, and the occurrence of the density unevenness caused by the pitch of the groove portions was evaluated. Here, a state where no density unevenness was present is represented by A, a state where hardly any density unevenness occurred except subtle density unevenness is represented by B, and a state where obvious density unevenness occurred is represented by F. The results are shown in Table 1. As shown in Table 1, the pitch Ps/(Vs/Vdr) on the photosensitive drum 81 corresponding to the pitch Ps of the groove portions 24*a* of the developing sleeve 24 and the pitch Pdr of the recess portions 81*a* of the photosensitive drum 81 were both smaller than 1 mm.

TABLE 1

| | Vs/Vdr | Ws | Ws/(Vs/Vdr) | Ps | Ps/(Vs/Vdr) | Pdr | DENSITY UNEVENNESS |
|---|---|---|---|---|---|---|---|
| COMPARATIVE EXAMPLE | 1.8 | 0.135 mm | 0.075 mm | 0.785 mm | 0.436 mm | 0.095 mm | F |
| EXAMPLE 1 | 1.8 | 0.135 mm | 0.075 mm | 0.785 mm | 0.436 mm | 0.06 mm | B |
| EXAMPLE 2 | 1.8 | 0.135 mm | 0.075 mm | 0.785 mm | 0.436 mm | 0.049 mm | A |
| EXAMPLE 3 | 1.8 | 0.135 mm | 0.075 mm | 0.785 mm | 0.436 mm | 0.03 mm | A |
| EXAMPLE 4 | 1.8 | 0.135 mm | 0.075 mm | 0.785 mm | 0.436 mm | 0.045 mm | B |
| EXAMPLE 5 | 1.358 | 0.135 mm | 0.1 mm | 0.785 mm | 0.581 mm | 0.095 mm | B |

Comparative Example

In a photosensitive drum 81 of Comparative Example, the recess portions 81*a* were periodically arranged on the photosensitive drum 81 in the rotation direction R2 with the pitch Pdr set to 0.095 mm. The pitch Pdr of the recess portions 81*a* of the photosensitive drum 81 in the rotation direction R2 was larger than the width Ws/(Vs/Vdr) on the photosensitive drum 81 corresponding to the width Ws of the groove portions 24*a* of the developing sleeve 24. Therefore, beat occurred, and a large density unevenness occurred in the circumferential direction and the visibility was degraded.

Example 1

In Example 1, the pitch Pdr of the recess portions 81*a* of the photosensitive drum 81 in the rotation direction R2 was set to 0.06 mm, which was smaller than in Comparative Example. Therefore, the pitch Pdr of the recess portions 81*a* of the photosensitive drum 81 in the rotation direction R2 was smaller than the width Ws/(Vs/Vdr) on the photosensitive drum 81 corresponding to the width Ws of the groove portions 24*a* of the developing sleeve 24. Therefore, the occurrence of beat was suppressed, and an effect better than in Comparative Example was obtained. However, since the pitch Pdr of the recess portions 81*a* was larger than Ps/(Vs/Vdr)/1.5, overlapping of some of the groove portions 24*a* and the recess portions 81*a* was insufficient, and slight density unevenness occurred in some cases.

Example 2

In Example 2, the pitch Pdr of the recess portions 81*a* of the photosensitive drum 81 in the rotation direction R2 was set to 0.049 mm, which was smaller than in Example 1. Therefore, the pitch Pdr of the recess portions 81*a* of the photosensitive drum 81 in the rotation direction R2 was smaller than 1/1.5 of the width Ws/(Vs/Vdr) on the photosensitive drum 81 corresponding to the width Ws of the groove portions 24*a* of the developing sleeve 24, that is, smaller than 0.05 mm. Therefore, the overlapping became more sufficient than in Example 1, and thus the occurrence of beat was more highly suppressed.

Example 3

In Example 3, the pitch Pdr of the recess portions 81*a* of the photosensitive drum 81 in the rotation direction R2 was set to 0.03 mm, which was further smaller than in Example 2. Therefore, the pitch Pdr of the recess portions 81*a* of the photosensitive drum 81 in the rotation direction R2 was smaller than ½ of the width Ws/(Vs/Vdr) on the photosensitive drum 81 corresponding to the width Ws of the groove portions 24*a* of the developing sleeve 24, that is, smaller than 0.0375 mm. Therefore, the overlapping became more sufficient, and thus the occurrence of beat was more highly suppressed.

Example 4

In Example 4, the pitch Pdr of the recess portions 81*a* of the photosensitive drum 81 in the rotation direction R2 was set to 0.045 mm, which was further smaller than in Example 2. Therefore, the pitch Pdr of the recess portions 81*a* of the photosensitive drum 81 in the rotation direction R2 was smaller than 1/1.5 of the width Ws/(Vs/Vdr) on the photosensitive drum 81 corresponding to the width Ws of the groove portions 24*a* of the developing sleeve 24, that is, smaller than 0.05 mm, and thus an effect better than Comparative Example was obtained. However, in contrast with the case of Example 2, slight density unevenness occurred in Example 4. The reason for this is considered to be because Ws/(Vs/Vdr) was a multiple of Pdr in the configuration of Example 4. This is because, in such a case, the strength of constructive interference become substantially equal at all the groove portions 24*a*, and the constructive interference may become too strong in some cases.

Example 5

In Example 5, the configuration of the photosensitive drum 81 and the developing sleeve 24 is the same as in Example 1. However, the peripheral speed rate Vs/Vdr of the developing sleeve 24 with respect to the photosensitive drum was lowered to 1.35. Therefore, the pitch Pdr of the recess portions 81*a* of the photosensitive drum 81 in the rotation direction R2 was smaller than the width Ws/(Vs/Vdr) on the photosensitive drum 81 corresponding to the width Ws of the groove portions 24*a* of the developing sleeve 24. Therefore, the occurrence of beat was suppressed. In this way, a configuration that can achieve the effect of the present invention can be achieved by not only changing the shape and dimensions of the photosensitive drum 81 and the developing sleeve 24.

According to Examples described above, it has been confirmed that the occurrence of the density unevenness caused by the periodical beat between the groove portions 24*a* and the recess portion 81*a* can be suppressed by the image forming apparatus 1 according to the present exemplary embodiment. To be noted, although a case where the same developing sleeve 24 was used in all of Examples described above has been described, the configuration that can achieve the effect of the present invention can be of course also achieved by changing the shape or pitch Ps of the groove portions 24*a* of the developing sleeve 24.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-091716, filed May 2, 2017, which is hereby incorporated by reference herein in its entirety.

What is claimed is:

1. An image forming apparatus comprising:

a rotatable image bearing member, configured to carry a toner image, with first recess portions provided at intervals substantially equal to a first pitch Pdr (mm) in a rotation direction of the image bearing member; and a rotatable developer bearing member, configured to carry developer comprising toner and carrier and to form the toner image on the image bearing member, with second recess portions provided at intervals substantially equal to a second pitch Ps (mm) in a rotation direction of the developer bearing member, wherein the following relationship is satisfied $$Vs/Vdr < Ws/Pdr$$

where Vdr represents a movement speed (mm/sec) of the first recess portions, Vs represents a movement speed (mm/sec) of the second recess portions, and Ws represents a length (mm) of each of the second recess portions in the rotation direction of the developer bearing member.

2. The image forming apparatus according to claim 1, wherein Vs/Vdr>1 is satisfied.

3. The image forming apparatus according to claim 1, wherein Vs/Vdr>1.35 is satisfied.

4. The image forming apparatus according to claim 1, wherein the first pitch Pdr of the first recess portions satisfies 0.01 mm≤Pdr<1 mm.

5. The image forming apparatus according to claim 1, wherein the first pitch Pdr of the first recess portions satisfies 0.01 mm≤Pdr<0.2 mm.

6. The image forming apparatus according to claim 1, wherein the second pitch Ps of the second recess portions satisfies 0.01×(Vs/Vdr) mm≤Ps<(Vs/Vdr) mm.

7. The image forming apparatus according to claim 1, wherein the second pitch Ps of the second recess portions satisfies 0.01×(Vs/Vdr) mm≤Ps<0.2×(Vs/Vdr) mm.

8. The image forming apparatus according to claim 1, wherein Ps/(Vs/Vdr) is a non-integer multiple of Pdr.

9. The image forming apparatus according to claim 1, wherein, in a case of forming the toner image on the image bearing member, only a direct current voltage is applied to the developer bearing member.

10. The image forming apparatus according to claim 1, wherein the first recess portions each have a circular shape.

11. The image forming apparatus according to claim 1, wherein a maximum length of a straight line crossing a first recess portion is longer than 3.0 μm and shorter than 14.0 μm.

12. The image forming apparatus according to claim 1, wherein the second recess portions are grooves extending in a direction of a rotation axis of the developer bearing member.

* * * * *